United States Patent [19]

Griffin et al.

[11] Patent Number: 4,476,068

[45] Date of Patent: Oct. 9, 1984

[54] PROGRESSIVE THROTTLE POSITIONING SYSTEM

[75] Inventors: Michael D. Griffin, Rochester; Donald J. Lamirande, Spencerport, both of N.Y.

[73] Assignee: General Motors Corporation, Detroit, Mich.

[21] Appl. No.: 539,271

[22] Filed: Oct. 5, 1983

[51] Int. Cl.[3] ..... G05G 7/04

[52] U.S. Cl. ..... 261/65; 74/513; 74/516

[58] Field of Search ..... 261/41 C, 65; 74/513, 74/516

[56] References Cited

U.S. PATENT DOCUMENTS

| | | | |
|---|---|---|---|
| 1,926,634 | 9/1933 | See et al. | 74/516 |
| 2,436,897 | 3/1948 | Nutt | 74/516 |
| 2,749,100 | 6/1956 | Carlson | 261/23 A |
| 3,334,874 | 8/1967 | Stettner | 261/23 A |
| 3,342,454 | 9/1967 | Tutch | 261/65 |
| 3,398,937 | 8/1967 | Stoltman | 261/23 A |
| 3,490,294 | 1/1970 | Antrim | 74/513 |
| 3,628,773 | 12/1971 | Keho et al. | 261/23 A |
| 3,852,379 | 12/1974 | Shishido et al. | 261/65 |
| 4,207,273 | 6/1980 | Siegmund | 261/41 C |
| 4,237,747 | 12/1980 | Dudleston et al. | 74/516 |
| 4,352,483 | 10/1982 | Iacoponi | 74/513 |

*Primary Examiner*—Tim Miles

*Attorney, Agent, or Firm*—C. K. Veenstra

[57] ABSTRACT

A drive lever mounted adjacent a throttle shaft is connected through a link to a throttle lever secured to the throttle shaft. The link is contorted to initially engage the throttle lever at a location which provides a large lever arm for initial throttle opening movement and to thereafter engage the throttle lever at a location which provides a smaller lever arm for subsequent throttle opening movement. The link further engages the throttle lever in a manner which assures throttle closing movement of the throttle lever over the entire range of throttle closing movement of the drive lever.

7 Claims, 6 Drawing Figures

PROGRESSIVE THROTTLE POSITIONING SYSTEM

TECHNICAL FIELD

This invention relates to a system for positioning a throttle adapted to control air flow to an engine.

BACKGROUND

Progressive throttle positioning systems have been employed in various automotive internal combustion engine applications to provide the desired control over air flow to the engine. Typically, a progressive throttle positioning system has a link operating a throttle lever so that a large lever arm is provided for initial throttle opening movement and a smaller lever arm is employed for subsequent throttle opening movement. In such applications, the throttle closing force provided by a throttle return spring maintains the throttle lever in contact with the link to assure that the throttle closes whenever the link is retracted.

SUMMARY OF THE INVENTION

In order to reduce axial and side loading on the throttle shaft, it is now suggested that the major throttle return springs operate on a separate drive lever mounted adjacent the throttle lever and connected to the throttle lever by a contorted link. The contorted link will perform its throttle opening functions by engaging the throttle lever at a location providing a large lever arm for initial throttle opening movement and at a location providing a smaller lever arm for subsequent throttle opening movement. In addition, the link will engage the throttle lever at a third location to assure throttle closing movement of the throttle lever over the entire range of throttle closing movement of the drive lever.

As other features provided by this invention, the idle or closed throttle position of the throttle lever is established by engagement between the throttle lever and the link, and a portion of the throttle lever is deformable to allow factory calibration of the idle or closed throttle position of the throttle lever.

As further features provided by this invention, the wide open throttle position of the throttle lever is established by engagement between the throttle lever and the link, and a portion of the link is deformable to allow factory calibration of the wide open throttle position of the throttle lever.

The details as well as other features and advantages of two embodiments of this invention are set forth in the remainder of the specification and are shown in the accompanying drawings.

THE PREFERRED EMBODIMENT

Referring first to FIGS. 1–4, a throttle body 10 for an automotive spark ignition internal combustion engine has a bore 12 forming a portion of an induction passage for air flow to the engine. A throttle shaft 14 is journalled in throttle body 10 and supports a throttle 16 in bore 12.

Figure 1:
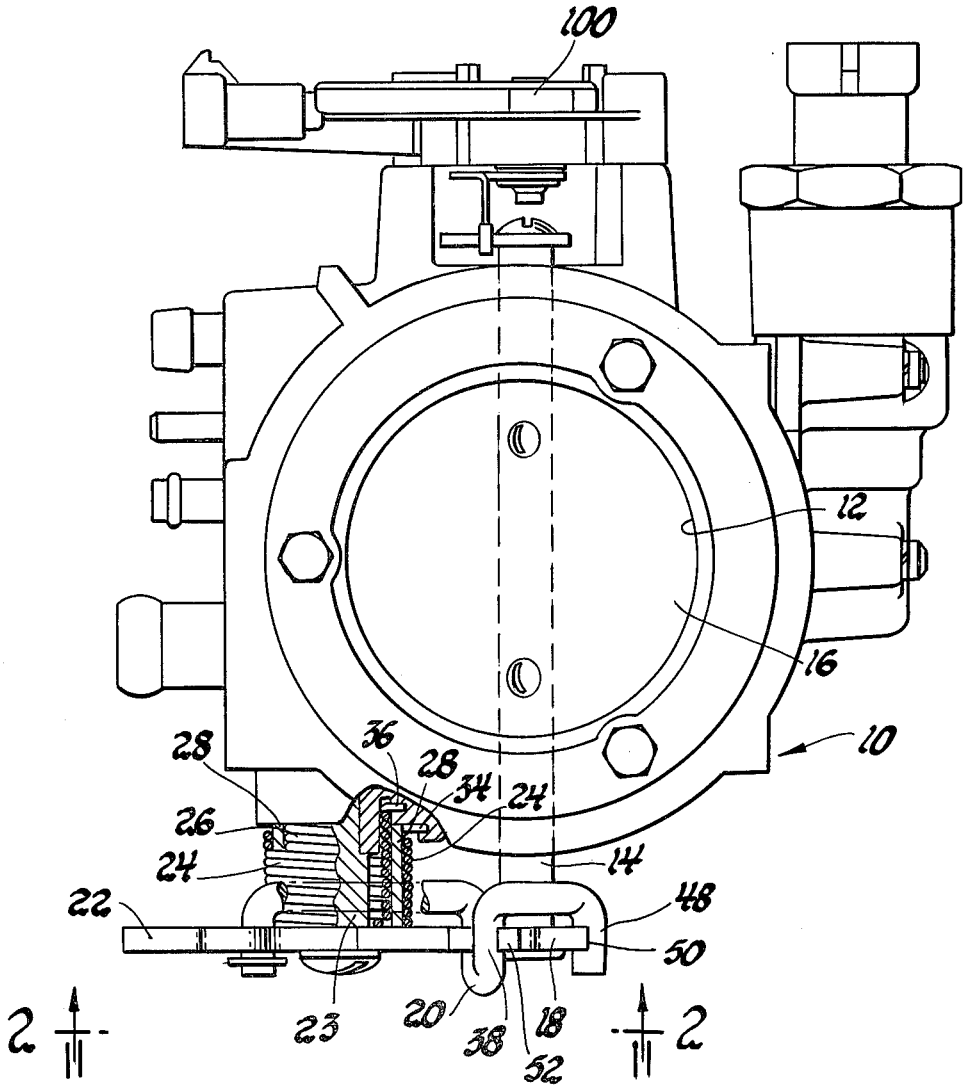
FIG. 1 is a plan view of an engine air induction system throttle body having a progressive throttle positioning system according to this invention.
Figure 2:
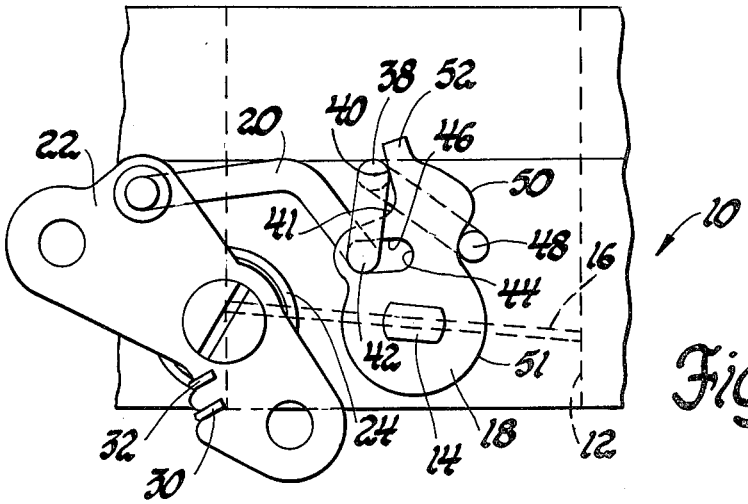
FIG. 2 is a side view of the FIG. 1 throttle body showing the throttle positioning system in the idle or closed throttle position.
Figure 3:
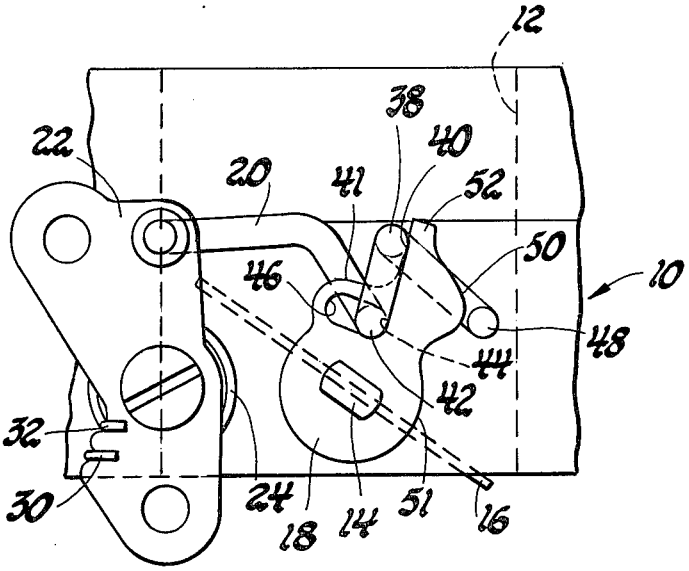
FIG. 3 is a view similar to FIG. 2 showing the throttle positioning system in a position intermediate the idle and wide open throttle positions.
Figure 4:
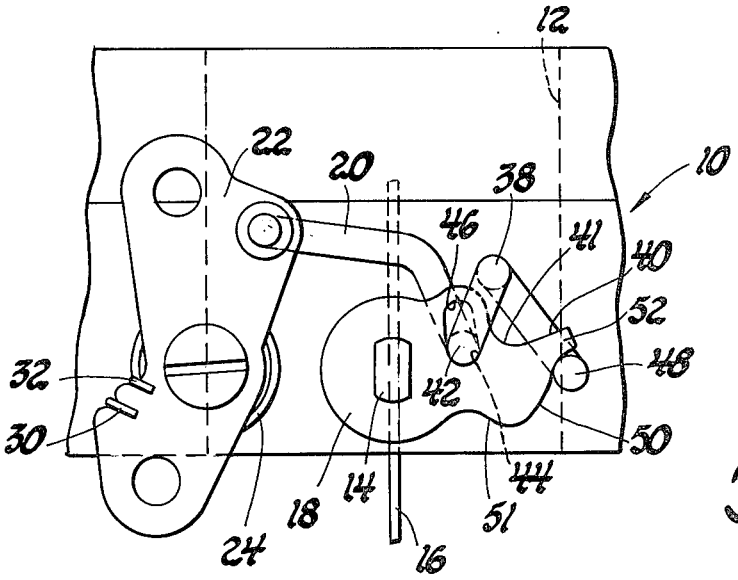
FIG. 4 is a view similar to FIG. 2 showing the throttle positioning system in the wide open throttle position.

A throttle lever 18 is secured to throttle shaft 14 and is connected by a contorted link 20 to a drive lever 22. Drive lever 22 is pivoted on a stud 23 extending from throttle body 10 adjacent throttle shaft 14. As shown in FIG. 1, a pair of throttle return springs 24 and 26, separated by a sleeve 28, surrounds stud 23. Ends 30 and 32 of springs 24 and 26 engage drive lever 22, biasing drive lever 22 counterclockwise as shown in FIGS. 2–4. The other ends 34 and 36 of springs 24 and 26 engage throttle body 10 as shown in FIG. 1 to provide a reaction for the bias on drive lever 22.

As drive lever 22 is rotated in a clockwise throttle opening direction from the position shown in FIG. 2 to the position shown in FIG. 3, the portion 38 of link 20 engages the region 40 formed on the edge 41 of throttle lever 18 to cause initial throttle opening movement. As drive lever 22 is rotated in a clockwise throttle opening direction from the position shown in FIG. 3 to the position shown in FIG. 4, the portion 42 of link 20 engages the region 44 of throttle lever 18 formed by the righthand end of slot 46 to provide throttle opening movement. Region 40 provides a greater lever arm than region 44 to provide the desired throttle opening characteristics.

A third portion 48 of link 20 wraps around to engage a contoured region 50 formed on the opposite edge 51 of throttle lever 18. When drive lever 22 is rotated in a counterclockwise throttle closing direction, the portion 48 of link 20 engages the contoured region 50 of throttle lever 18 to assure throttle closing movement of throttle lever 18.

It will be noted from FIG. 2 that further counterclockwise throttle closing movement of throttle lever 18 is prevented by simultaneous engagement of throttle lever region 50 with link portion 48 and throttle lever region 40 with link portion 38. Such simultaneous engagement accordingly limits throttle closing movement of throttle lever 18 and establishes the closed throttle or idle position of throttle lever 18. The closed throttle or idle position of throttle lever 18 may be calibrated at the factory by bending the tab 52 at the tip of throttle lever 18 to adjust the position of region 40 relative to link portion 38 and thereby vary the position at which such simultaneous engagement occurs.

It will be noted from FIG. 4 that further clockwise throttle opening movement of throttle lever 18 is prevented by simultaneous engagement of link portion 42 with throttle lever region 44 and link portion 48 with throttle lever region 50. Such simultaneous engagement accordingly limits throttle opening movement of throttle lever 18 and establishes the wide open throttle position of throttle lever 18. The wide open throttle position of throttle lever 18 may be calibrated at the factory by bending link portion 48 to adjust the position of link portion 48 relative to region 50 and thereby vary the position at which such simultaneous engagement occurs.

Figure 5:
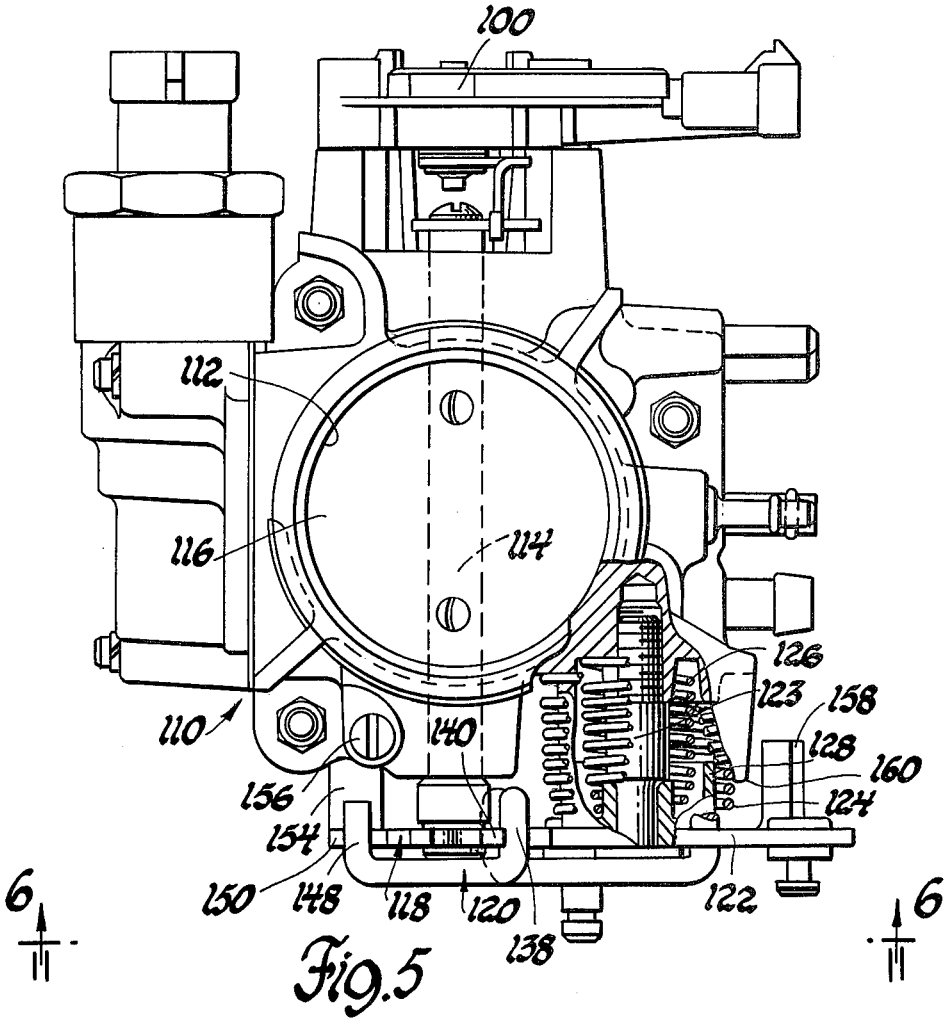
FIG. 5 is a view similar to FIG. 1 of another throttle body having another progressive throttle positioning system according to this invention.
Figure 6:
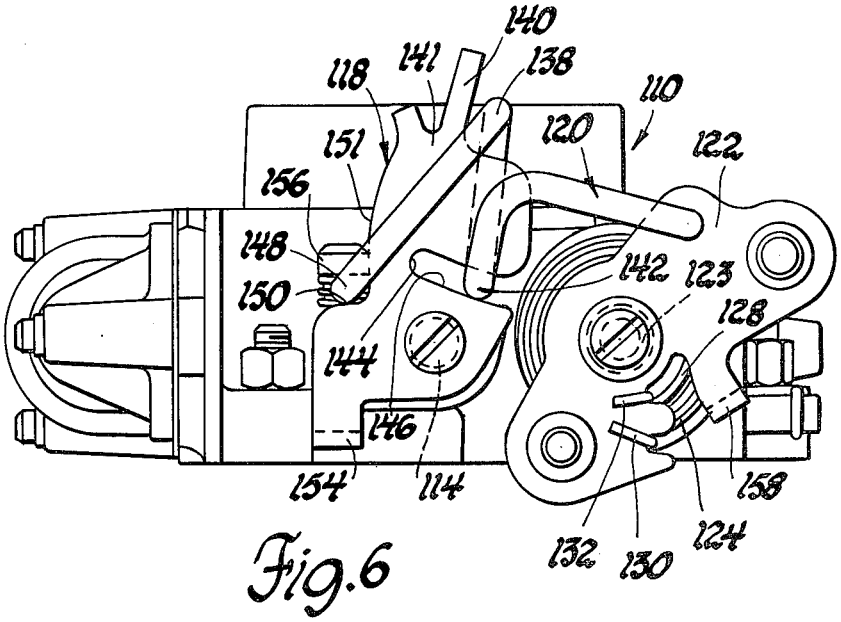
FIG. 6 is a side view of the FIG. 5 throttle body showing the throttle positioning system in the idle or closed throttle position.

Referring now to FIGS. 5–6, a throttle body 110 for an automotive spark ignition internal combustion engine has a bore 112 forming a portion of an induction passage for air flow to the engine. A throttle shaft 114 is journalled in throttle body 110 and supports a throttle 116 in bore 112.

A throttle lever 118 is secured to throttle shaft 114 and is connected by a contorted link 120 to a drive lever 122. Drive lever 122 is pivoted on a stud 123 extending from throttle body 110 adjacent throttle shaft 114. As shown in FIG. 5, a pair of throttle return springs 124 and 126, separated by a sleeve 128, surrounds stud 123. Ends 130 and 132 of springs 124 and 126 engage drive lever 122, biasing drive lever 122 clockwise as shown in FIG. 6. The other ends of springs 124 and 126 engage throttle body 110 to provide a reaction for the bias on drive lever 122.

As drive lever 122 is rotated in a counterclockwise throttle opening direction from the position shown in FIG. 5, the portion 138 of link 120 engages the region 140 formed on the edge 141 of throttle lever 118 to cause initial throttle opening movement. As drive lever 122 is thereafter rotated in a counterclockwise throttle opening direction, the portion 142 of link 120 engages the region 144 of throttle lever 118 formed by the left-hand end of recess or slot 146 to provide throttle opening movement. Region 140 provides a greater lever arm than region 144 to provide the desired throttle opening characteristics.

A third portion 148 of link 120 wraps around to engage a contoured region 150 formed on the opposite edge 151 of throttle lever 118. When drive lever 122 is rotated in a clockwise throttle closing direction, the portion 148 of link 120 engages the contoured region 150 of throttle lever 118 to assure throttle closing movement of throttle lever 118.

It will be noted from FIG. 6 that further clockwise throttle closing movement of throttle lever 118 is prevented by engagement of a tab 154 on throttle lever 118 with an adjusting screw 156 mounted on throttle body 110. Such engagement establishes the closed throttle or idle position of throttle lever 118. The closed throttle or idle position of throttle lever 118 may be calibrated at the factory by turning adjusting screw 156 to vary the position at which such engagement occurs.

As in the embodiment of FIGS. 1–4, counterclockwise throttle opening movement of throttle lever 118 is limited by simultaneous engagement of link portion 142 with throttle lever region 144 and link portion 148 with throttle lever region 150. Such simultaneous engagement prevents throttle lever 118 from rotating past a wide open throttle position. In this embodiment, the wide open throttle position of drive lever 122, and thus of throttle lever 118, is established by engagement of a tab 158 on drive lever 122 with a boss 160 formed on throttle body 110.

In both embodiments, a light spring in the throttle position sensor 100 exerts a throttle closing force on throttle shaft 14, 114 to maintain throttle lever 18, 118 in contact with link 20, 120 and thus close throttle 16, 116 whenever link 20, 120 is retracted by throttle closing movement of drive lever 22, 122. Irrespective of the effect of the spring in throttle position sensor 100, however, with this invention engagement of the third portion 48, 148 of link 20, 120 with the contoured region 50, 150 of throttle lever 18, 118 assures throttle closing movement of throttle lever 18, 118 whenever link 20, 120 is retracted by throttle closing movement of drive lever 22, 122.

The embodiments of the invention in which an exclusive property or privilege is claimed are defined as follows:

1. A system for positioning a throttle secured to a shaft and adapted to control air flow to an engine, said system comprising a throttle lever secured to said shaft, a drive lever pivotally mounted adjacent said shaft, and a contorted link connected at one end to said drive lever, said link having a first portion adapted to engage a first region of said throttle lever to effect initial throttle opening movement of said throttle lever during initial throttle opening movement of said drive lever and a second portion adapted to engage a second region of said throttle lever to effect subsequent throttle opening movement of said throttle lever during subsequent throttle opening movement of said drive lever, said portions being disposed at spaced locations along the length of said link, and wherein said link has an additional portion disposed at a third location along the length of said link, said additional portion being adapted to engage a third region of said throttle lever to effect throttle closing movement of said throttle lever over the entire range of throttle closing movement of said drive lever.

2. A system for positioning a throttle secured to a shaft and adapted to control air flow to an engine, said system comprising a throttle lever secured to said shaft, a drive lever pivotally mounted adjacent said shaft, and a contorted link connected at one end to said drive lever, one edge of said throttle lever having a first region engaged by a first portion of said link to effect initial throttle opening movement of said throttle lever during initial throttle opening movement of said drive lever, said throttle lever further having a second region engaged by a second portion of said link to effect subsequent throttle opening movement of said throttle lever during subsequent throttle opening movement of said drive lever, said portions being disposed at spaced locations along said link, and wherein the opposite edge of said throttle lever has a contoured third region engaged by a third portion of said link to effect throttle closing movement of said throttle lever over the entire range of throttle closing movement of said drive lever, said third portion being disposed at a location along the length of said link spaced from said first and second portions.

3. A system for positioning a throttle secured to a shaft and adapted to control air flow to an engine, said system comprising a throttle lever secured to said shaft, a drive lever pivotally mounted adjacent said shaft, and a contorted link connected at one end to said drive lever, one edge of said throttle lever having a first region engaged by a first portion of said link to effect initial throttle opening movement of said throttle lever during initial throttle opening movement of said drive lever, said throttle lever further having a second region engaged by a second portion of said link to effect subsequent throttle opening movement of said throttle lever during subsequent throttle opening movement of said drive lever, said portions being disposed at spaced location along said link, wherein the opposite edge of said throttle lever has a contoured third region engaged by a third portion of said link to effect throttle closing movement of said throttle lever over the entire range of throttle closing movement of said drive lever, said third portion being disposed at a location along the length of said link spaced from said first and second portions, and wherein said first and third regions of said throttle lever are engaged simultaneously by said first and third portions of said link to limit throttle closing movement of said throttle lever.

4. A system for positioning a throttle secured to a shaft and adapted to control air flow to an engine, said system comprising a throttle lever secured to said shaft, a drive lever pivotally mounted adjacent said shaft, and a contorted link connected at one end to said drive lever, one edge of said throttle lever having a first region engaged by a first portion of said link to effect initial throttle opening movement of said throttle lever during initial throttle opening movement of said drive lever, said throttle lever further having a second region engaged by a second portion of said link to effect subsequent throttle opening movement of said throttle lever during subsequent throttle opening movement of said drive lever, said portions being disposed at spaced locations along said link, wherein the opposite edge of said throttle lever has a contoured third region engaged by a third portion of said link to effect throttle closing movement of said throttle lever over the entire range of throttle closing movement of said drive lever, said third portion being disposed at a location along the length of said link spaced from said first and second portions, wherein said first and third regions of said throttle lever are engaged simultaneously by said first and third portions of said link to limit throttle closing movement of said throttle lever, and wherein said throttle lever is deformable to adjust the position of said first region relative to the first portion of said link and thereby establish the idle position to which throttle closing movement of said throttle lever is limited.

5. A system for positioning a throttle secured to a shaft and adapted to control air flow to an engine, said system comprising a throttle lever secured to said shaft, a drive lever pivotally mounted adjacent said shaft, and a contorted link connected at one end to said drive lever, one edge of said throttle lever having a first region engaged by a first portion of said link to effect initial throttle opening movement of said throttle lever during initial throttle opening movement of said drive lever, said throttle lever further having a second region engaged by a second portion of said link to effect subsequent throttle opening movement of said throttle lever during subsequent throttle opening movement of said drive lever, said portions being disposed at spaced locations along said link, wherein the opposite edge of said throttle lever has a contoured third region engaged by a third portion of said link to effect throttle closing movement of said throttle lever over the entire range of throttle closing movement of said drive lever, said third portion being disposed at a location along the length of said link spaced from said first and second portions, and wherein said second and third regions of said throttle lever are engaged simultaneously by said second and third portions of said link to limit throttle opening movement of said throttle lever.

6. A system for positioning a throttle secured to a shaft and adapted to control air flow to an engine, said system comprising a throttle lever secured to said shaft, a drive lever pivotally mounted adjacent said shaft, and a contorted link connected at one end to said drive lever, one edge of said throttle lever having a first region engaged by a first portion of said link to effect initial throttle opening movement of said throttle lever during initial throttle opening movement of said drive lever, said throttle lever further having a second region engaged by a second portion of said link to effect subsequent throttle opening movement of said throttle lever during subsequent throttle opening movement of said drive lever, said portions being disposed at spaced locations along said link, wherein the opposite edge of said throttle lever has a contoured third region engaged by a third portion of said link to effect throttle closing movement of said throttle lever over the entire range of throttle closing movement of said drive lever, said third portion being disposed at a location along the length of said link spaced from said first and second portions, wherein said second and third regions of said throttle lever are engaged simultaneously by said second and third portions of said link to limit throttle opening movement of said throttle lever, and wherein said link is deformable to adjust the position of said third portion relative to the third region of said throttle lever and thereby establish the wide open throttle position to which throttle opening movement of said throttle lever is limited.

7. A system for positioning a throttle secured to a shaft and adapted to control air flow to an engine, said system comprising a throttle lever secured to said shaft, a drive lever pivotally mounted adjacent said shaft, and a contorted link connected at one end to said drive lever, one edge of said throttle lever having a first region engaged by a first portion of said link to effect initial throttle opening movement of said throttle lever during initial throttle opening movement of said drive lever, said throttle lever further having a second region engaged by a second portion of said link to effect subsequent throttle opening movement of said throttle lever during subsequent throttle opening movement of said drive lever, said portions being disposed at spaced locations along said link, wherein the opposite edge of said throttle lever has a contoured third region engaged by a third portion of said link to effect throttle closing movement of said throttle lever over the entire range of throttle closing movement of said drive lever, said third portion being disposed at a location along the length of said link spaced from said first and second portions, wherein said first and third regions of said throttle lever are engaged simultaneously by said first and third portions of said link to limit throttle closing movement of said throttle lever, wherein said throttle lever is deformable to adjust the position of said first region relative to the first portion of said link and thereby establish the idle position to which throttle closing movement of said throttle lever is limited, wherein said second and third regions of said throttle lever are engaged simultaneously by said second and third portions of said link to limit throttle opening movement of said throttle lever, and wherein said link is deformable to adjust the position of said third portion relative to the third region of said throttle lever and thereby establish the wide open throttle position to which throttle opening movement of said throttle lever is limited.

* * * * *